US006282826B1

(12) United States Patent
Richards

(10) Patent No.: US 6,282,826 B1
(45) Date of Patent: Sep. 4, 2001

(54) PROTECTIVE HOLDER AND METHOD OF USING SAME

(76) Inventor: James R. Richards, 12310 - 50th Ave. CT NW., Gig Harbor, WA (US) 98332

( * ) Notice: Subject to any disclaimer, the term of this patent is extended or adjusted under 35 U.S.C. 154(b) by 0 days.

(21) Appl. No.: 09/239,026

(22) Filed: Jan. 27, 1999

(51) Int. Cl.[7] ..... G09F 3/20

(52) U.S. Cl. ..... 40/651.01; 40/775; 40/776

(58) Field of Search ..... 40/775, 776, 654.01; 281/37; 283/65, 36, 37, 38, 41, 42, 21, 44

(56) References Cited

U.S. PATENT DOCUMENTS

| | | | | |
|---|---|---|---|---|
| 2,253,814 | * | 8/1941 | Sames | 40/776 |
| 2,477,886 | | 8/1949 | McCaskill . | |
| 3,245,166 | | 4/1966 | Hagner . | |
| 3,587,187 | * | 6/1971 | Sibley | 40/776 |
| 3,685,187 | | 8/1972 | Hillmer . | |
| 3,735,516 | | 5/1973 | Wenstrom . | |
| 3,797,146 | | 3/1974 | Holes . | |
| 3,816,948 | | 6/1974 | Mooney et al. . | |
| 3,866,648 | | 2/1975 | Anderson . | |
| 4,065,864 | | 1/1978 | Stanley . | |
| 4,173,837 | | 11/1979 | Kiejzik . | |
| 4,196,536 | | 4/1980 | Westberg . | |
| 4,508,224 | | 4/1985 | Weber et al. . | |
| 4,533,048 | | 8/1985 | Ozeki . | |
| 4,958,450 | | 9/1990 | Roberg . | |
| 5,000,319 | | 3/1991 | Mermelstein . | |
| 5,119,574 | | 6/1992 | King . | |
| 5,186,566 | | 2/1993 | Cameron . | |

FOREIGN PATENT DOCUMENTS

| | | | | |
|---|---|---|---|---|
| 165956 | * | 5/1950 | (AT) | 40/775 |
| 367110 | * | 12/1920 | (DE) | 40/159 FOR |

* cited by examiner

*Primary Examiner*—Cassandra H. Davis
(74) *Attorney, Agent, or Firm*—E. Russell Tarleton; Seed IP Law Group PLLC

(57) ABSTRACT

A protective holder for storing and displaying articles, such as photographs, baseball cards, game cards, and the like. The holder is formed from a front sheet that is welded to a back sheet to form a plurality of pockets. Cuts are made in the back sheet to create flaps with tabs that facilitate lifting of the flap for insertion and removal of articles in a manner that minimizes contact damage between the articles and the holder. The flaps are coplanar with the back sheet at all times to prevent indentation of the stored articles when pressure is applied to the flaps. This also enables insertion of entire holder into a thicker, stiffer sheath for further protection, if desired, without the problem of objects dislodging and falling out in the thicker, stiffer sheath.

20 Claims, 10 Drawing Sheets

PROTECTIVE HOLDER AND METHOD OF USING SAME

TECHNICAL FIELD

The present invention pertains to a device for holding and protecting articles, and, more particularly, to a transparent, protective holder for storing and displaying sports cards, trading cards, game cards, photographs, and the like, and method of using the same.

BACKGROUND OF THE INVENTION

Numerous designs have been proposed for pages that store and protect thin, substantially flat objects. These pages are typically formed from plastic and have pouches to hold the objects. Multiple pages are generally bound in releasable binders to provide an additional level of protection and to facilitate viewing of the objects stored therein. Pouches formed with an open top or side have the disadvantage of allowing objects stored therein to dislodge or fall out. Partially exposed or loose objects are easily subject to being lost, damaged, or destroyed.

Another disadvantage is the damage the page itself causes to stored objects. Collectable objects, such as rare photographs, baseball cards, and trading cards, generally increase in value as they age. Worn or bent display faces, and frayed edges and corners will substantially reduce their value. Many page designs facilitate such damage by exposing the faces and edges of stored objects to chafing. Chafing can occur, for example, when objects are being inserted into or removed from the pouch, when the pages themselves are being turned, or when pages are stored on top of each other.

More recently, very valuable or potentially valuable objects are placed within individual sleeves before insertion into the pouch. This facilitates removal and inspection without risk of soiling or damaging the object. Because a sleeved object has extra bulk, it is difficult to insert into and remove out of existing pouches. Hence, there is a need for a protective holder that securely stores and displays sleeved and unsleeved articles, and facilitates easy insertion and removal in order to minimize contact damage.

SUMMARY OF THE INVENTION

The present invention is directed to a transparent, protective holder for storing and displaying articles. The holder comprises a front sheet formed from transparent material and having an exterior surface and an interior surface; a back sheet having an exterior surface and an interior surface, the back sheet being attached to the front sheet to form a plurality of pockets. Ideally the pockets are sealed along all sides. Each pocket has a cut formed in the back sheet that is sized and shaped to enable insertion of an article into the pocket. The cut forms a flap on the back sheet to cover a portion of the article in the pocket. The flap includes a flap member and a tab formed on the flap member, the tab having a size and shape to enable manual grasping and lifting of the flap, thereby minimizing contact with the article during insertion and removal.

In accordance with another aspect of the present invention, a matching cutout is formed in the back sheet, and the flap is received in the cutout such that the flap is coplanar with the back sheet.

In accordance with yet another aspect of the present invention, either of the front sheet and the back sheet include holes to facilitate placement of the holder in a releasable binder.

In accordance with a further aspect of the present invention, a storage system for holding and displaying substantially thin, planar articles having a display face and a back face is provided. The storage system comprises a page formed from a front sheet and a back sheet; the front sheet having a top edge, a bottom edge, an interior edge, and an exterior edge, and is formed from at least translucent, plastic material with an exterior surface and an interior surface; the back sheet formed from plastic material and having an exterior surface and an interior surface. The interior surface of the back sheet is attached to the interior surface of the front sheet along a plurality of seam lines to form one or more pockets. Ideally, each of the pockets has a rectangular shape with a longitudinal dimension greater than a transverse dimension, the longitudinal dimension defined by a pair of parallel longitudinal side seams and the transverse dimension defined by a pair of parallel transverse side seams, the longitudinal side seams and the transverse side seams sealing all sides of the pocket. Each pocket has a cut formed in the back sheet that is sized and shaped to enable insertion of an article into the pocket. The cut divides the back sheet of the pocket into a first portion and a second portion, with the first portion comprising a tab that is sized and shaped to enable manual grasping of the tab and lifting of the first portion of the back sheet of the pocket. It is to be understood, however, that other shapes may be used, such as a square shape.

In accordance with yet a further aspect of the present invention, the tab of the storage system is attached to the first sheet by one of either the longitudinal side seams and the transversed side seams.

In accordance with still yet a further aspect of the present invention, the storage system further comprises at least one thin, substantially flat article having a display face and a back face, the article being slidably received within one of the pockets. The tab associated with each pocket is sized such that when the article is fully inserted within the pocket, the article holds the tab against the interior surface of the first sheet; and bending and unbending the page along the seam that attaches the tab to the first sheet urges the tab out of the pocket and against the back face of the article such that the tab is coplanar with the second portion of the pocket.

In accordance with still yet another aspect of the present invention, a method of using a storage system that includes a flexible page for storing substantially thin, planar articles having a display face and a back face is provided. The page has a front sheet with an exterior surface and an interior surface, and a back sheet with an interior surface and an exterior surface. The back sheet has its interior surface attached to the interior surface of the front sheet to form a plurality of pockets, each pocket having a cut in the back sheet sized and shaped to enable insertion of the article in the pocket. The cut divides the back sheet of the packet into a first portion and a second portion and forms a tab in the first portion. The first portion is held to the front sheet by a seam. The method involves inserting the article in a selected pocket through the opening formed by the cut in the back sheet of the selected pocket such that the article holds the tab against the interior surface of the front sheet; bending the page along the seam to urge the tab out of the pocket; and unbending the page to position the tab against the back face of the article.

In accordance with yet another aspect of the method of the present invention, the method further comprises grasping the tab of a selected pocket and lifting the tab to form an opening to the pocket; and removing the article from the pocket through the formed opening.

As will be readily appreciated from the foregoing, the present invention securely retains articles in a pocket regardless of the orientation of the pocket. In addition, articles can be inserted into the pocket through an enlarged opening, preventing or minimizing contact between the display face of the object and the edge of the cut in the back sheet. The back of the pocket has a planar, flat surface that prevents indentation of the stored articles. Flaps are formed on the backside of the pocket, providing an unobstructed view through the front side. Pocket flaps can be lifted individually, permitting items to be inserted and removed in user-selected pockets without disturbing and risking damage to the contents of other pockets. Finally, because the holder is flat, it can be more easily inserted into a larger, thicker sheath to provide a greater level of protection.

BRIEF DESCRIPTION OF THE DRAWINGS

The foregoing and other features and advantages of the present invention will be more readily appreciated as the same become better understood from the following detailed description when taken in conjunction with the accompanying drawings, wherein.

DETAILED DESCRIPTION OF THE EMBODIMENTS

Figure 1:
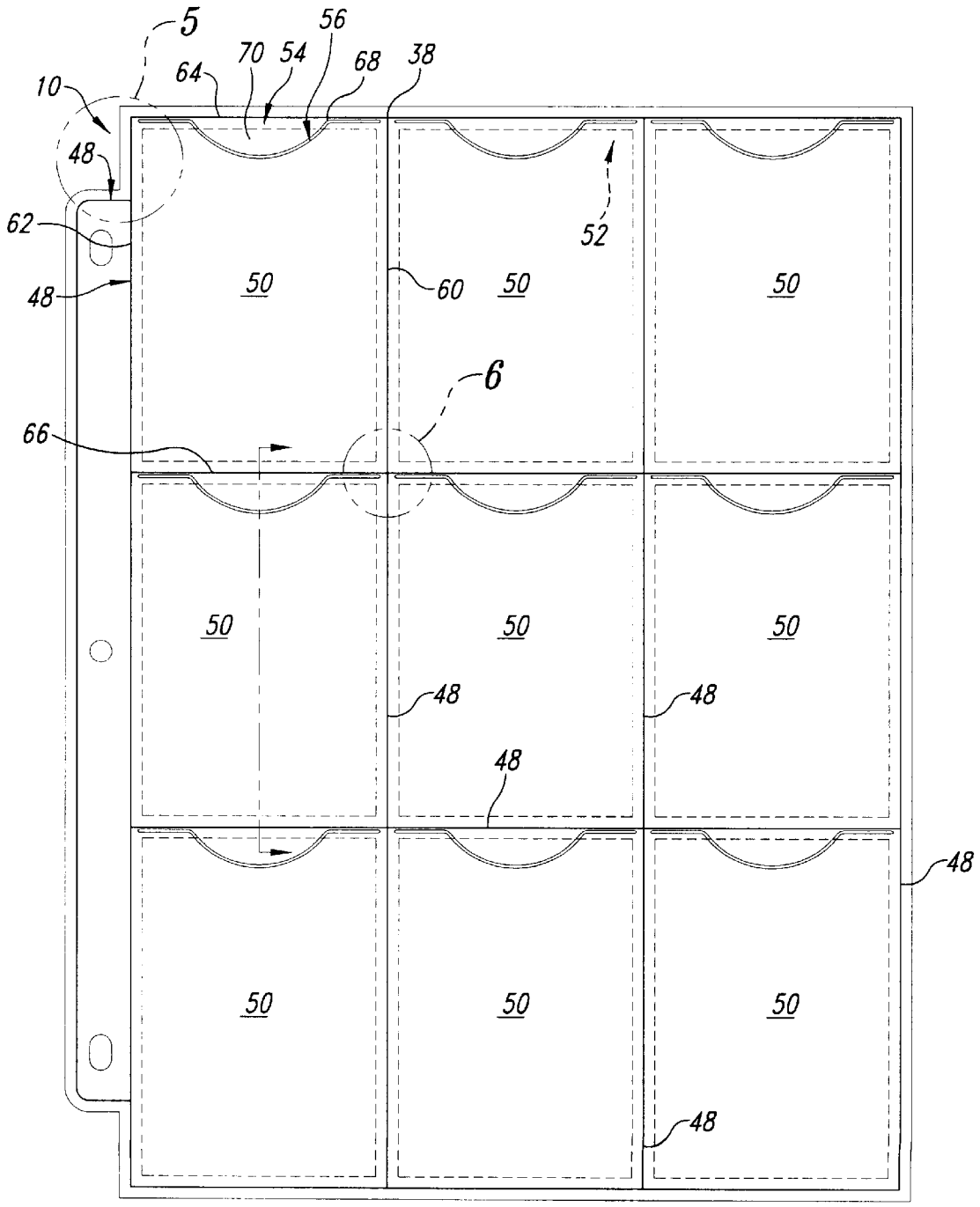
FIG. 1 is a front elevational view of a protective holder formed in under one embodiment of the invention.
Figure 2:
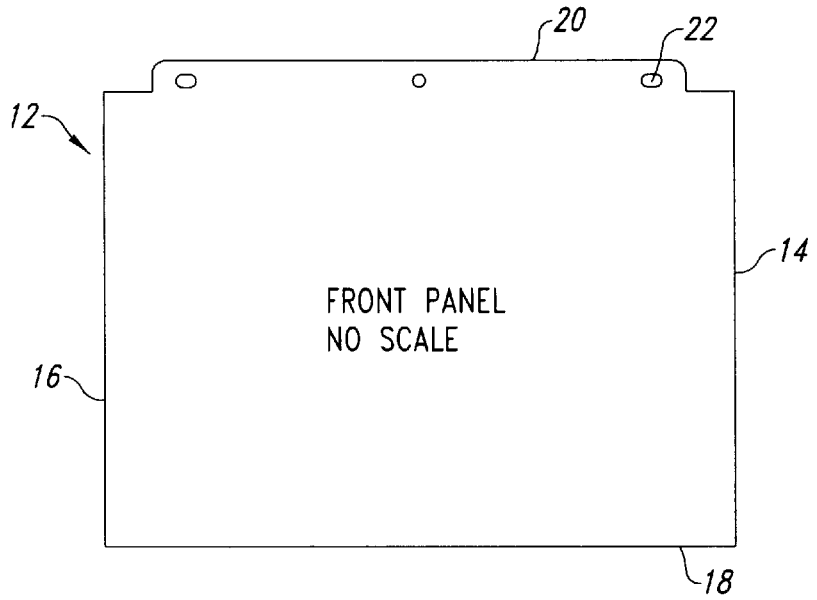
FIG. 2 is a front elevational view of a front sheet of the protective holder of FIG. 1.
Figure 3:
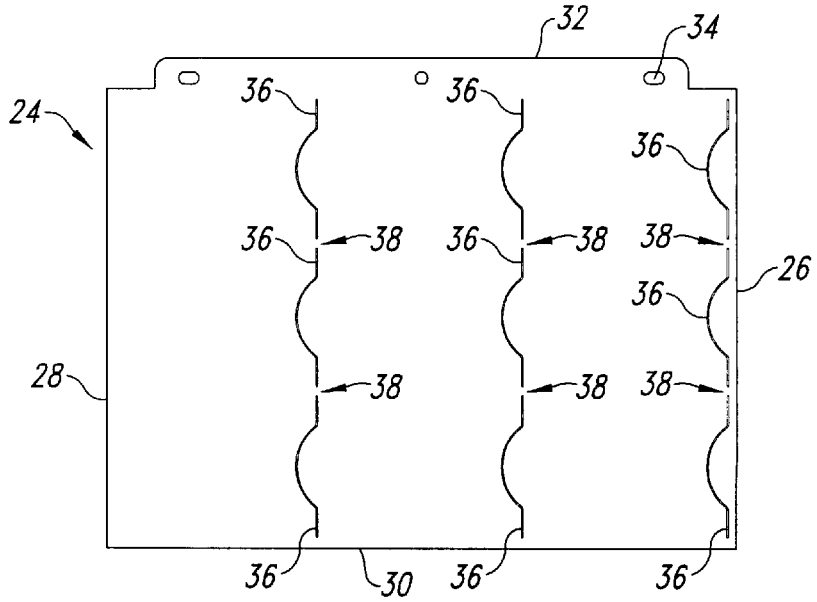
FIG. 3 is a front elevational view of the back sheet of the protective holder of FIG. 1.

Referring initially to FIGS. 1–3, shown therein is a protective holder 10. The protective holder 10 is formed from a front sheet 12 and a back sheet 24. The front sheet 12 has a top edge 14, bottom edge 16, exterior edge 18, and interior edge 20. Positioned at selected points along the interior edge 20 are a plurality of holes 22.

The back sheet 24 shown in FIG. 3 has a top edge 26, bottom edge 28, exterior edge 30, and an interior edge 32 with holes 34 adjacent thereto. The holes 34 in the back sheet 24 have the same size and relative positioning as the holes 22 in the front sheet 12 when secured together to enable placement in a releasable binder (not shown) when the holder 10 is assembled. The holes 34 can be formed after the front and back sheets 12 and 24 are secured together. Cuts 36 are formed in the back sheet 24 (in this embodiment there are nine cuts 36). Each of the cuts 36 is separated from the other cuts 36 by an uncut space 38. The cuts 36 can be formed by die cutting or other suitable method known in the art, prior to assembly of the holder 10.

Ideally, the front sheet 12 and back sheet 24 are formed from plastic sheets of vinyl, polypropylene material, although other polyolefin material may be used. These sheets 12, 24 have a thickness in the range of 0.001 inch (1 mil) to 0.025 inch (25 mil). In one embodiment, the sheets have a preferred thickness of 3 mil. Thicker sheets could have a thickness of 25 mil such as for a large protective sheath.

The protective holder 10 is formed by attaching the back sheet 24 to the front sheet 12. The back sheet 24, which has an interior surface 40 and an exterior surface 42, is preferably thermal contact welded to the front sheet 12, which has an interior surface 44 and an exterior surface 46. As can be seen more clearly in FIG. 12A, the interior surface 40 of the back sheet is attached to the interior surface 44 of the front sheet.

Figure 5:
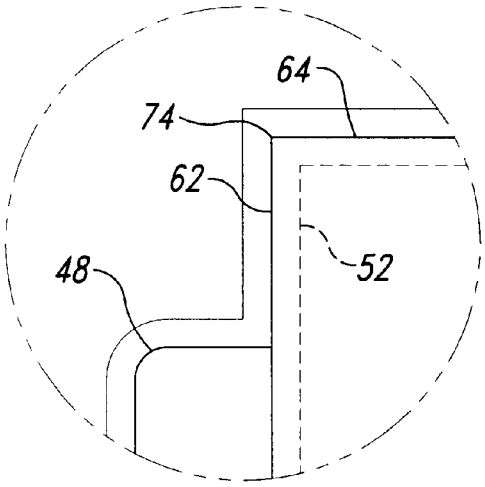
FIG. 5 is an enlarged front view of a pocket corner of the protective holder of FIG. 1.
Figure 6:
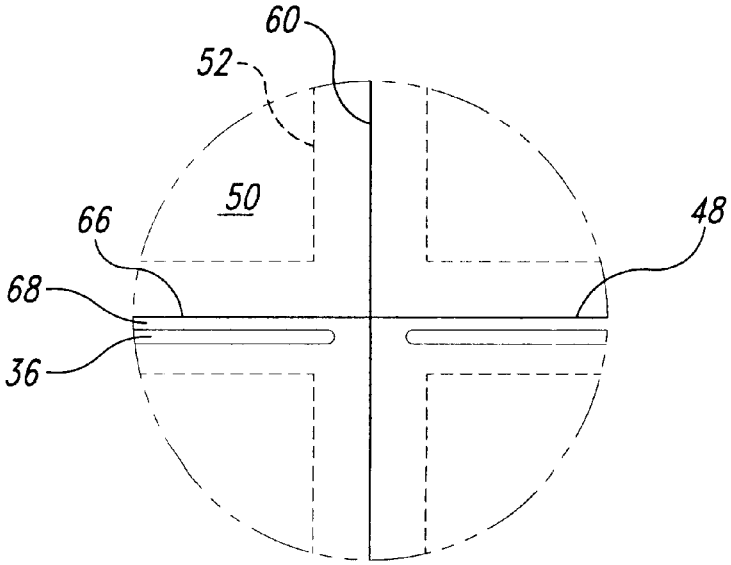
FIG. 6 is an enlarged elevational view of the intersection of four pocket corners of the protective holder of FIG. 1.

The welding of the back sheet 24 to the front sheet 12 forms weld lines or seams 48 that intersect to create a plurality of pockets 50 (in this case nine). In the embodiment shown in FIG. 1, the seams 48 intersect in the uncut spaces 38 between the cuts 36. The comer seams 74 and seam intersections 76, are shown in greater detail in FIGS. 5 and 6, respectively. The dashed lines shown inside each pocket 50 represent an article 52, such as a baseball card. The cuts 36 form a flap 54 in each pocket 50 and a corresponding cutout 56 in the back wall 58 of the pocket 50 to create an opening through which the article 52 is inserted.

Thus, each pocket 50 has a rectangular shape that is defined by the pair of parallel longitudinal seams, i.e., exterior longitudinal seam 60 and interior longitudinal seam 62, and the pair of parallel transverse side seams, i.e., upper transverse seam 64 and lower transverse seam 66, that seal all sides of the pocket 50. The only opening into the pocket 50 is that formed by the cut 36.

The flap 54 has a flap member portion 68 that is attached to the front sheet 12 by the upper transverse seam 64. A tab 70 projects from the flap member 68 into the cutout 56 formed in the back wall 58 of the pocket 50. Ideally, the flap 54 is coplanar with the back wall 58 at all times, both when an article 52 is inserted in the pocket 50 and when the pocket 50 is empty.

Figure 4:
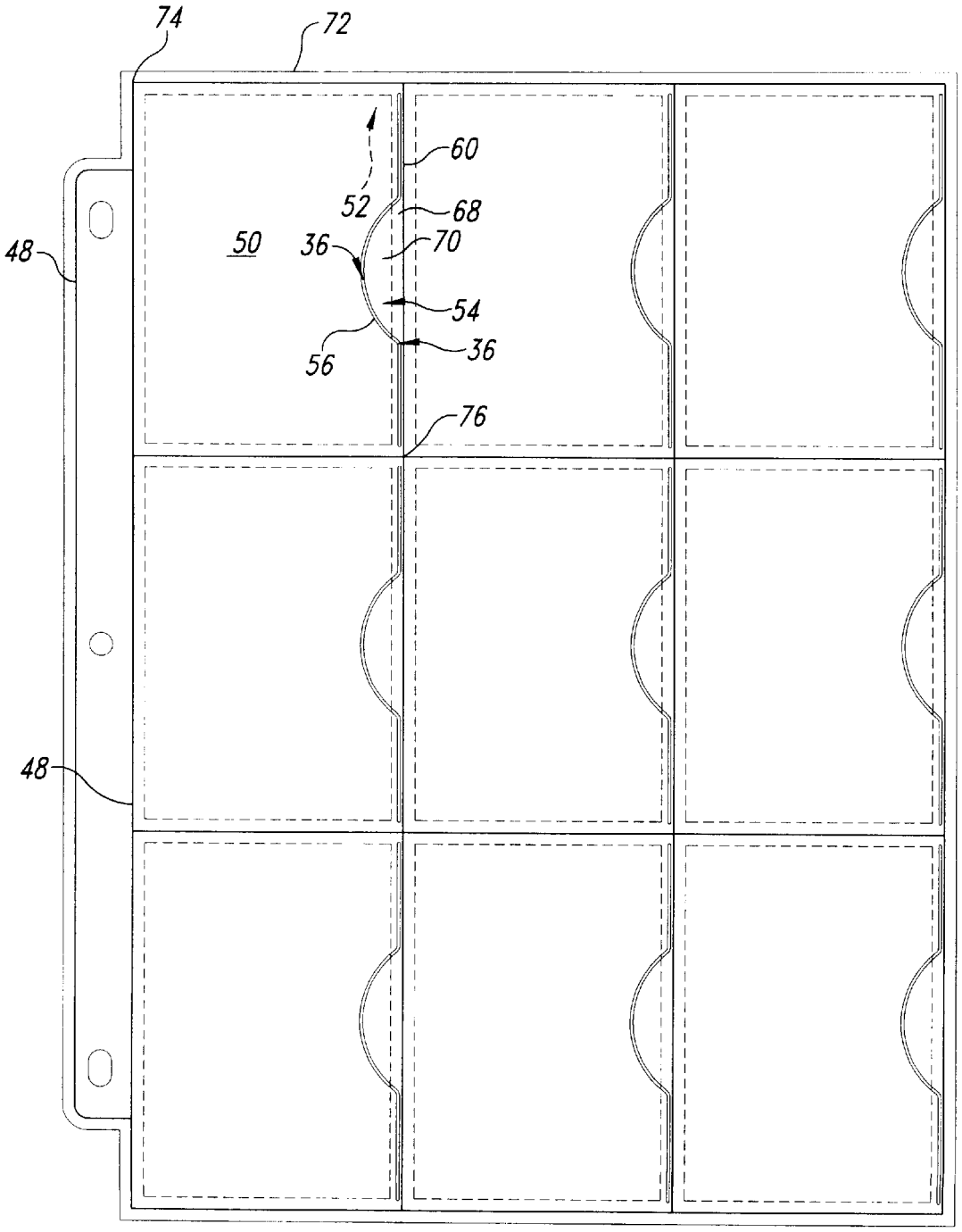
FIG. 4 is a front elevational view of an alternative embodiment of the protective holder.
Figure 7:
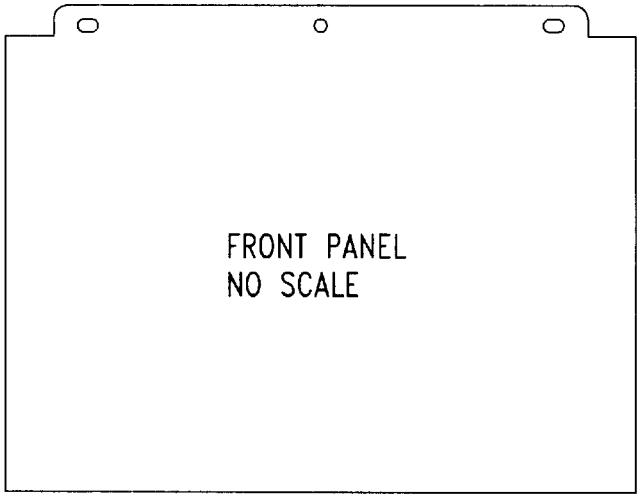
FIG. 7 is a front elevational view of a front sheet of the alternative embodiment of the protective holder of FIG. 4.
Figure 8:
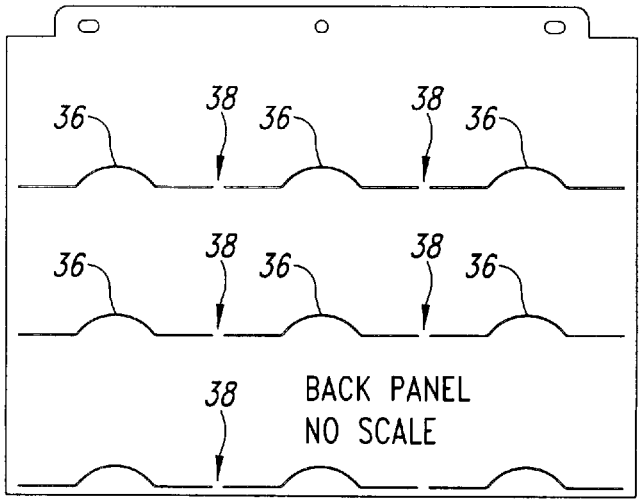
FIG. 8 is a front elevational view of a back sheet of the protective holder of FIG. 7.

FIGS. 4, and 7–8 show an alternative embodiment wherein a protective holder 72 has flaps 54 positioned so that the flap member 68 is attached to the front sheet 12 along the exterior longitudinal seam 60. (For convenience and ease of reference, the same reference numerals from the embodiment depicted in FIGS. 1–3 will be used with respect to the other embodiments of the protective holder described herein.) The cuts 36 of this second embodiment are oriented longitudinally so that articles 52 are inserted from the exterior side of the pocket 50. Other than the repositioning of the flap 54, with appropriate sizing and reorientation of the cuts, as shown in FIG. 8, this embodiment shown is essentially identical to the embodiment of the protective holder 10 shown in FIGS. 1–3.

Figure 9:
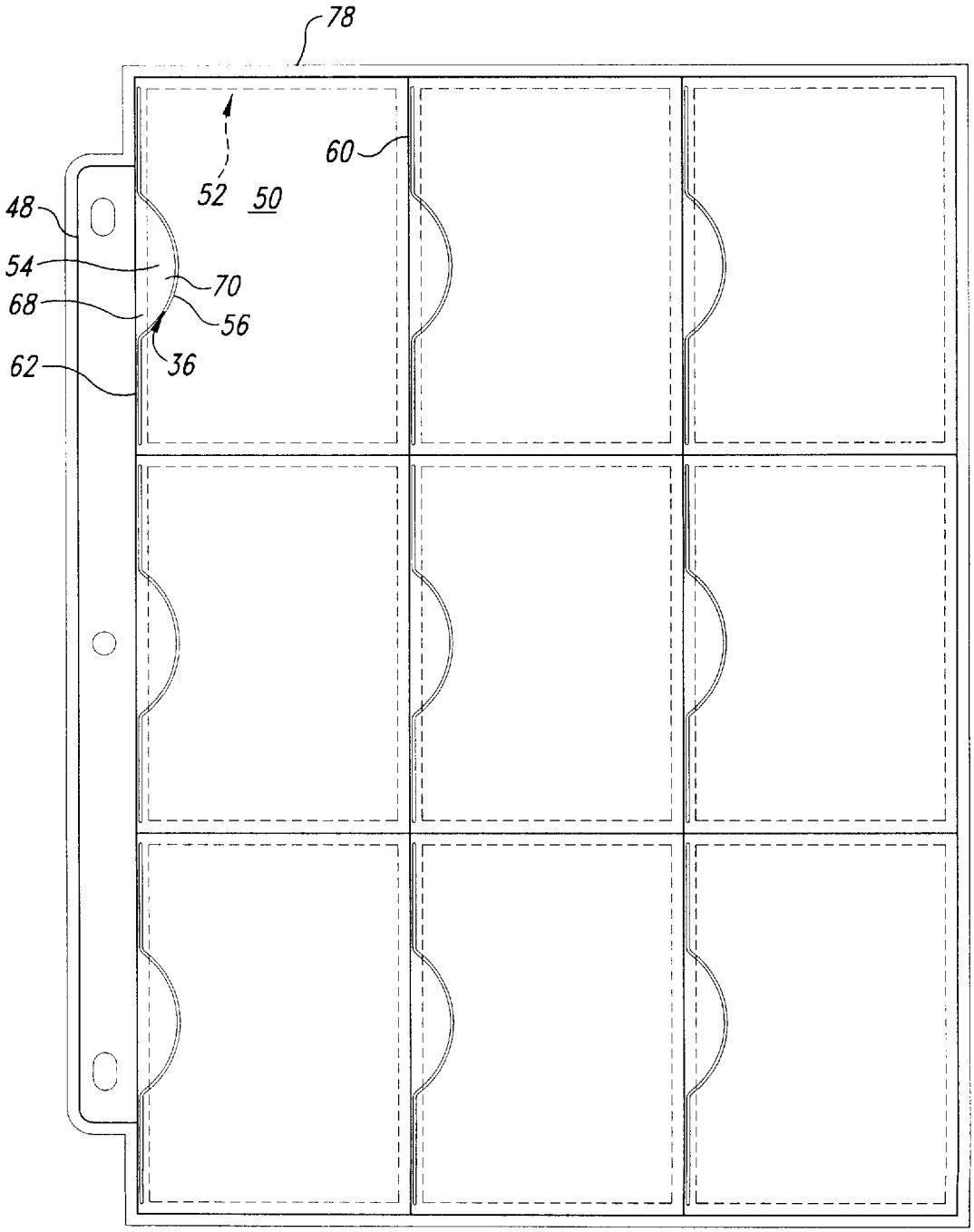
FIG. 9 is a front elevational view of a second alternative embodiment of a protective.

Referring next to FIG. 9, illustrated therein is a further alternative embodiment of a protective holder 78. In this embodiment, the flaps 54 are attached to the front sheet 12 along the interior longitudinal seam 62. This embodiment of the protective holder 78 is essentially a mirror image of the first alternative embodiment of the protective holder 72 shown in FIG. 4, and it incorporates the features of the embodiments described above.

Figure 10:
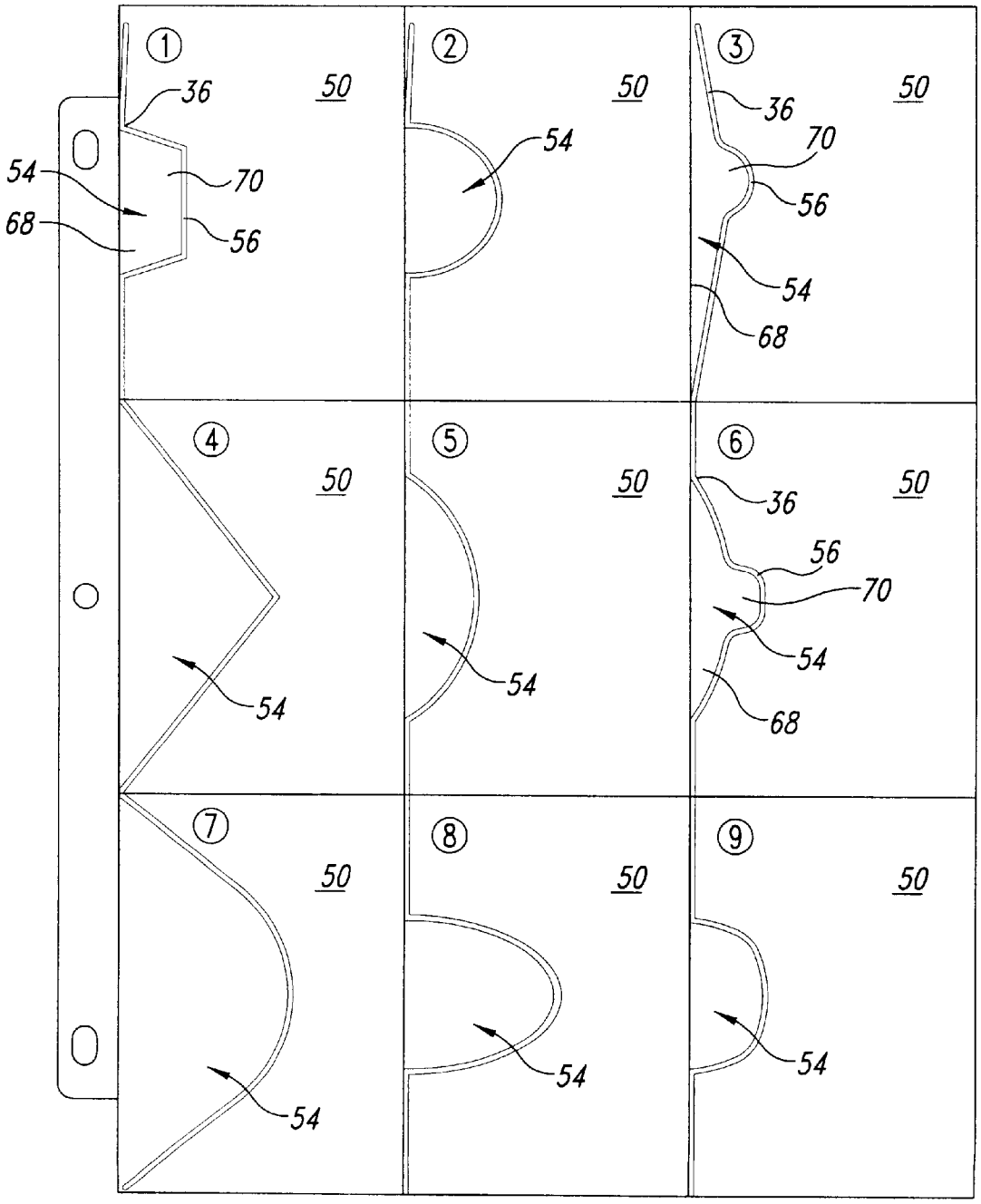
FIG. 10 shows alternative embodiments of pocket flap and tab configurations on a protective holder page.
Figure 11A:
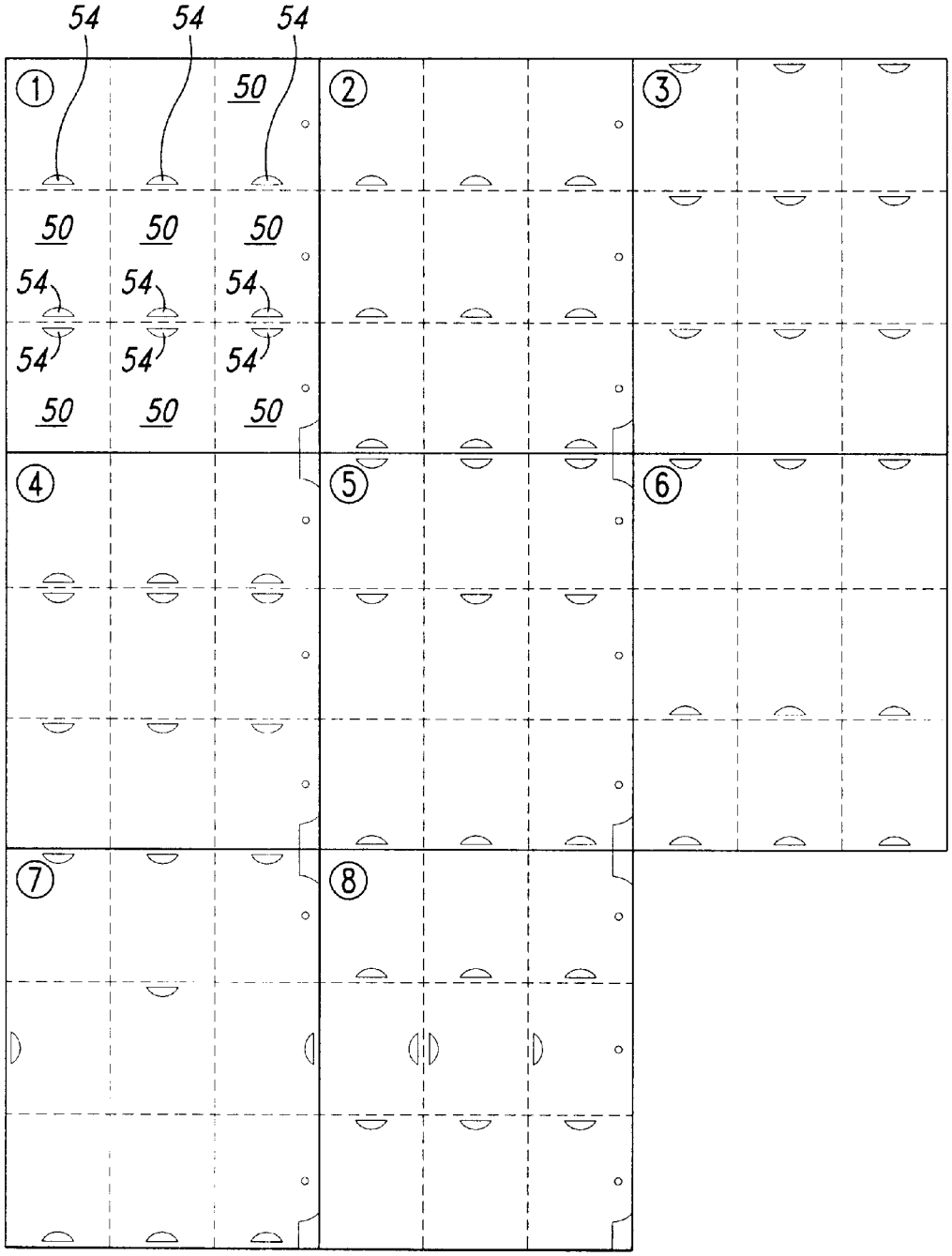
FIGS. 11A and 11B show alternative embodiments of pocket flap and tab orientations on a protective holder page.
Figure 11B:
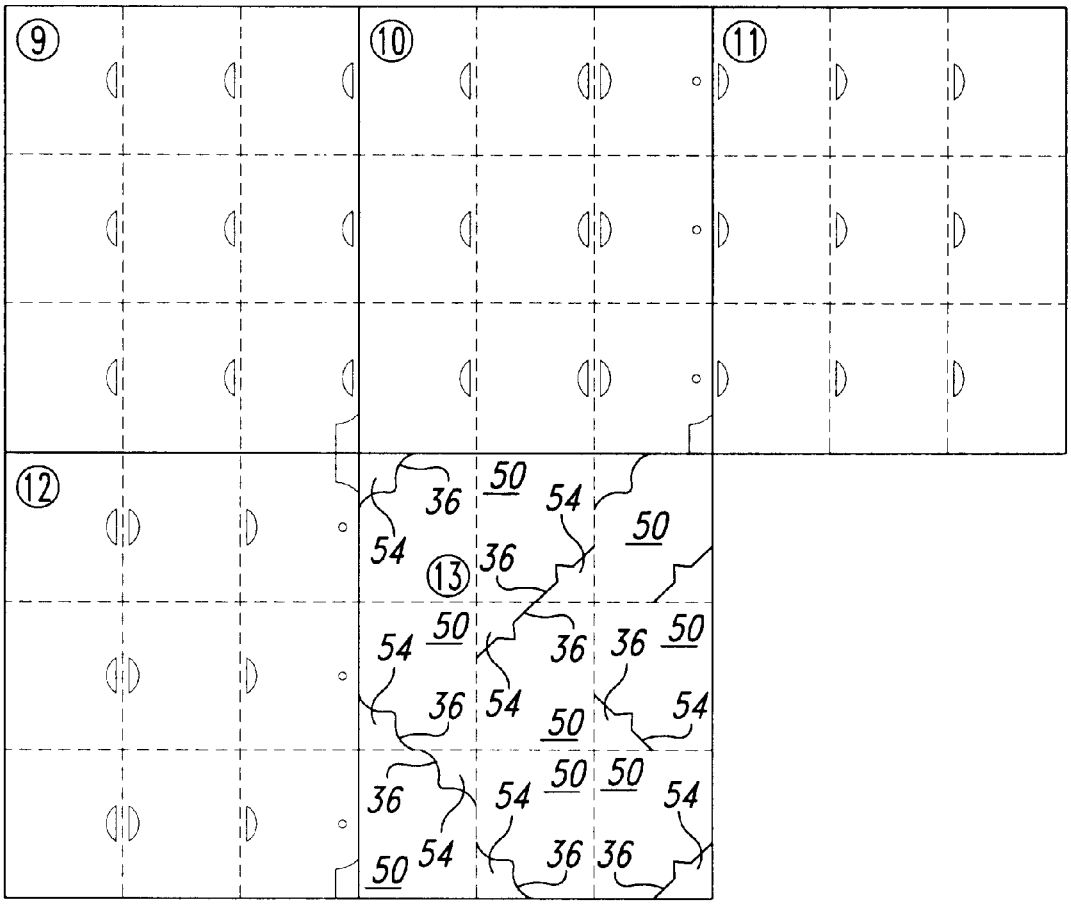

The flaps 54 can be made in a variety of shapes. FIG. 10 shows nine variations of the flap 54, but other shapes and configurations are possible. Each of these flaps 54 can be positioned along any of the four seams or across adjacent seams. FIGS. 11A–11B illustrate alternative positions of the flaps 54 on thirteen different pages numbered 1–13. The construction of the embodiments shown in FIGS. 10 and 11A–11B is essentially the same as that described in connection with the protective holders 10, 72, 78 above. Page 13 in FIG. 11B shows alternative positioning of the cuts 36 with respect to each individual pocket 50. As shown therein, the cuts 36 extend from adjacent sides of the pocket 50, i.e., across a corner, instead of along only one side as in the previous embodiments.

Figure 12C:
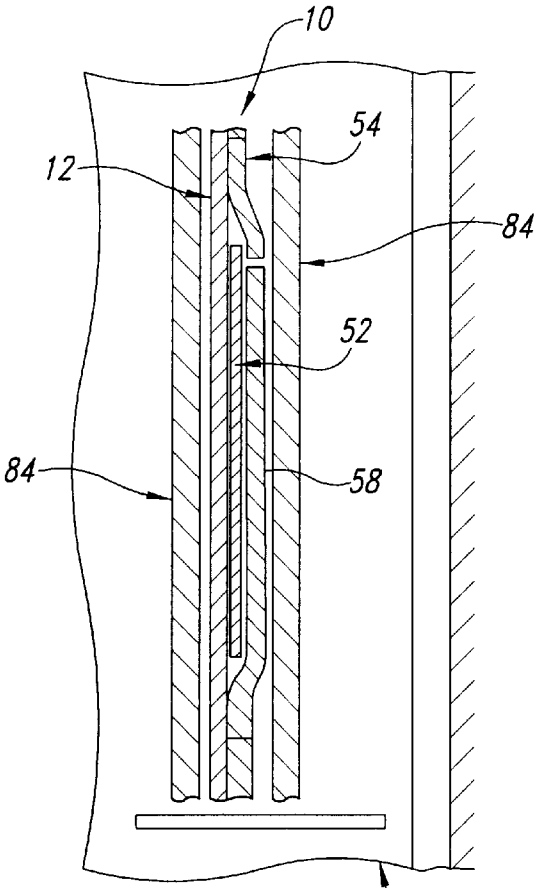
FIGS. 12A–12C illustrate a method of using the protective holder.
Figure 12B:
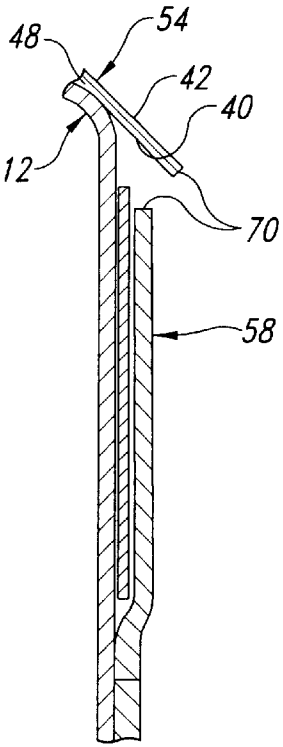
Figure 12A:
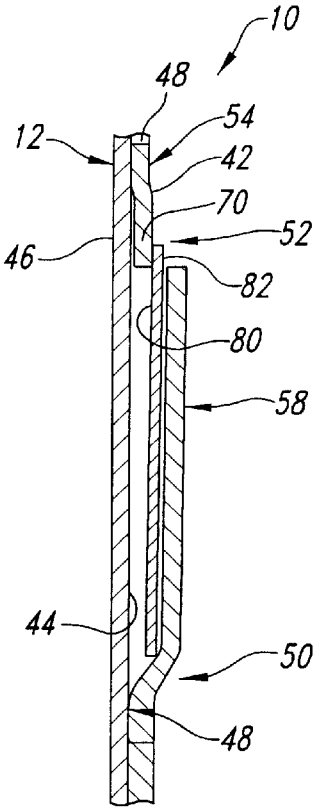

A method of using the system for protecting articles is shown in FIGS. 12A–12C. In accordance with one embodiment, an article 52 having a thin, substantially flat shape, such as a baseball card, and having a display face 80 and a back face 82, is initially positioned inside the pocket 50 with its display face 80 facing the interior surface 44 of the front sheet 12. The back face 82 of the article 52 is positioned against the interior surface 42 of the back wall 58 of the pocket 50. When so inserted, the display face 80 bears against the exterior surface 42 of the tab 70 to hold the interior surface 40 of the flap 54 against the interior surface 44 of the front sheet 12.

To reposition the tab 70 to the back side 82 of the article 52, a user bends the holder 10 along the seam 48 that holds the flap 54 to the front sheet 12. As the holder 10 is bent, the force and the resilience of the material of the flap 54 urges the tab 70 out of the pocket 50 as shown in FIG. 12B. Releasing the bending force on the seam 48 allows the holder 10 to return to its original position with the flap 54, including the tab 70, positioned so that the interior surface 40 is against the back side 82 of the object 52. The flap 54 does not overlap the back wall 50 but is essentially coplanar with the back wall 58 of the pocket 50. This avoids indentation of the stored article 52 when the flap 54 is under pressure, such as when stacked vertically with other holders or pages.

In order to remove the article 52, the tab 70 can be grasped and the flap 54 lifted up. An opening is then created that enables the article 52 to be removed from the pocket 50 while minimizing contact between the article 52 and the holder 10. The foregoing method is especially useful with articles 52 that have been initially positioned inside a sleeve before being inserted into the pocket 50. It is also useful with articles 52 where contact between the display face 80 and the flap 54 is of little or no consequence.

From the foregoing it will be appreciated that, although specific embodiments of the invention have been described herein for purposes of illustration, various modifications may be made without deviating from the spirit and scope of the invention. For example, the back sheet 24 may be opaque, translucent, or transparent. Accordingly, the invention is not limited except as by the appended claims.

In accordance with another method of use, a system for protecting and displaying articles is provided. Here, the protective holder 10 is inserted within a protective sheath that is formed from thicker, heavier material, ideally transparent plastic. The sheath 84 can be formed with the holes to enable secure binding of the sheath 84 and the holder 10 in a releasable binder 86. With this system, articles have an additional layer of protection, and the thicker, stiffer sheath 84 resists or prevents bending of the articles as the combined sheath 84 and holder 10 are turned in the binder 86. One commercially available sheath without holes for binding is known as a "top loader" available from PKK, Seattle Wash. This sheath will need to be formed with holes for binding.

Hence, the invention is to be limited only by the scope of the claims that follow.

The embodiments of the invention in which an exclusive property or privilege is claimed are defined as follows:

1. A protective holder for storing and displaying articles, comprising:

a front sheet formed from at least translucent, plastic material and having an exterior surface and an interior surface;

a back sheet having an exterior surface and an interior surface, the back sheet attached to the interior surface of the front sheet to form a plurality of pockets sealed along all sides; and each of the plurality of pockets having a cut formed in the back sheet adjacent a first edge of the pocket, the cut forming a flap member in the back sheet that is attached at the first edge of the pocket and that covers a smaller portion of the interior surface of the front sheet in the pocket than covered by the remaining portion of the back sheet, the cut further forming a tab on the flap member, the tab projecting away from the first edge and having a size and shape to bear against the interior surface of the front sheet and to enable manual grasping of the tab to lift the flap member and thereby minimize contact with the article during insertion and removal of the article from the pocket.

2. The holder of claim 1 wherein the cut forms a matching cutout in the back sheet to receive the tab and flap member so that the tab and flap member are coplanar with the back sheet.

3. The holder of claim 1 wherein either of the front and back sheet have a plurality of holes to enable storage of the holder in a releasable binder.

4. A storage system for holding and displaying substantially thin, flat articles that have a display face and a back face, the storage system comprising:

a page formed from a front sheet and a back sheet;

the front sheet having a top edge, a bottom edge, an interior edge, and an exterior edge, and being formed from at least translucent, plastic material with an exterior surface and an interior surface;

the back sheet having an exterior surface and an interior surface, the back sheet having its interior surface attached to the interior surface of the front sheet along a plurality of seam lines to form at least one pocket;

each of the at least one pockets having a longitudinal dimension greater than a transverse dimension, the longitudinal dimension defined by a pair of parallel longitudinal side seams and the transverse dimension defined by a pair of parallel transverse side seams, the longitudinal side seams and the transverse side seams sealing all sides of the pocket, each pocket having a cut formed in the back sheet adjacent a one of either the transverse and parallel side seams and that is sized and shaped to enable insertion of an article into the pocket; and each cut dividing the back sheet of the pocket into a first portion that is attached at the adjacent one of either the transverse and parallel side seams and a second portion that is larger than the first portion and is attached to the parallel side seams and the other of the transverse seams, with the first portion comprising a tab that projects away from the adjacent one of either the transverse and parallel side seams and that is sized and shaped to bear against the interior surface of the front sheet and to enable manual grasping of the tab and lifting of the first portion of the back sheet of the pocket.

5. The storage system of claim 4, further comprising at least one thin, substantially flat article having a display face and a back face, the article being slidably received within one of the pockets; and the tab associated with each pocket is sized such that when the article is fully inserted within the pocket, the article holds the tab against the interior surface of the first sheet, and when the page is bent along the seam that attaches the tab to the first sheet, the tab is urged out of the pocket and is positioned against the article and coplanar with the back sheet of the second portion of the pocket.

6. The storage system of claim 5 wherein either of the front and back sheet further include a plurality of holes to enable storage of the page in a releasable binder.

7. The system of claim 4 further comprising a stiff sheath in which the page is inserted, the sheath being formed from transparent material and including holes to enable binding of the sheath in a releasable binder.

8. The system of claim 4 further comprising a releasable binder that releasably binds at least one stiff sheath in which the page is inserted, the sheath being formed from transparent material and having a size and shape to enclose the page.

9. A method of using a storage system that includes a page for storing substantially thin, planar articles having a display face and a back face, the page having a front sheet with an exterior surface and an interior surface, and a back sheet having an interior surface and an exterior surface, the back sheet having its interior surface attached to the interior surface of the front sheet to form a plurality of pockets, each pocket having a cut in the back sheet sized and shaped to enable insertion of the article in the pocket, the cut dividing the back sheet into a first portion and a second portion, the first portion forming a tab that is held to the front sheet by a seam, the method comprising:

(a) inserting the article in a selected pocket through the opening formed by the cut in the back sheet of the selected pocket such that the article holds the tab against the interior surface of the front sheet;

(b) bending the page along the seam holding the tab to the front sheet to urge the tab out of the pocket; and (c) unbending the page along the seam holding the tab to the front sheet to position the tab against the article.

10. The method of claim 9 wherein unbending the page further comprises positioning the tab to be coplanar with the second portion of the back sheet of the selected pocket.

11. The method of claim 9, further comprising:

(d) grasping the tab of the selected pocket and lifting the tab to form an opening to the pocket; and (e) removing the article from the pocket.

12. A system for storing and displaying articles, comprising:

a transparent page having a plurality of transparent pockets formed thereon, each pocket having an opening sized and shaped to enable insertion of articles in the pockets the opening formed by a cut adjacent a first side of the pocket to form a flap that projects away from the first side and a tab on the flap that bears against an interior surface of the pocket; and a stiff sheath sized and shaped to receive the page, the sheath being formed from stiff transparent material.

13. The holder of claim 12, further comprising at least one article for display, the article having a thin, substantially flat configuration with a display face and an opposing back face, the article sized to be slideably receivable within the pockets.

14. The holder of claim 12, wherein the sheath has a plurality of holes; and further comprising a binder having releasable clamps for insertion through the plurality of holes in the sheath to hold the sheath in the binder.

15. A storage system for holding and displaying substantially thin, flat articles that have a display face and a back face, the storage system comprising:

a page formed from a front sheet and a back sheet;

the front sheet having a top edge, a bottom edge, an interior edge, and an exterior edge, and being formed from at least translucent, plastic material with an exterior surface and an interior surface;

the back sheet having an exterior surface and an interior surface, the back sheet having its interior surface attached to the interior surface of the front sheet along a plurality of seam lines to form one or more pockets;

each of the one or more pockets having a longitudinal dimension greater than a transverse dimension, the longitudinal dimension defined by a pair of parallel longitudinal side seams and the transverse dimension defined by a pair of parallel transverse side seams, the longitudinal side seams and the transverse side seams sealing all sides of the pocket, each pocket having a cut formed in the back sheet that is sized and shaped to enable insertion of an article into the pocket;

each cut dividing the back sheet of the pocket into a first portion and a second portion with the first portion smaller than the second portion and comprising a tab that is sized and shaped to bear against the interior surface of the front sheet and to enable manual grasping of the tab and lifting of the first portion of the back sheet of the pocket; and a stiff sheath in which the page is inserted, the sheath being formed from stiff transparent material and including holes to enable binding of the sheath.

16. The system of claim 15, further comprising at least one thin, substantially flat article having a display face and a back face, the article sized and shaped to be slideably receivable within at least one of the pockets.

17. The system of claim 16, wherein the tab associated with each pocket is sized such that when the article is fully inserted within the pocket, the article holds the tab against the interior surface of the first sheet, and the page is configured such that when the page is bent along the seam that attaches the tab to the first sheet, the tab is urged out of the pocket and is positioned against the article and coplanar with the back sheet of the second portion of the pocket.

18. The system of claim 15, further comprising a releasable binder that releasably binds at least one stiff sheath in which the page is inserted, the stiff sheath being formed from stiff transparent material and having a size and shape to enclose the page.

19. A storage system for holding and displaying substantially thin, flat articles that have a display face and a back face, the storage system comprising:

a page formed from a front sheet and a back sheet;

the front sheet having a top edge, a bottom edge, an interior edge, and an exterior edge, and being formed from at least translucent, plastic material with an exterior surface and an interior surface;

the back sheet having an exterior surface and an interior surface, the back sheet having its interior surface attached to the interior surface of the front sheet along a plurality of seam lines to form at least one pocket;

each of the at least one pockets having a longitudinal dimension greater than a transverse dimension, the longitudinal dimension defined by a pair of parallel longitudinal side seams and the transverse dimension defined by a pair of parallel transverse side seams, the longitudinal side seams and the transverse side seams sealing all sides of the pocket, each pocket having a cut formed in the back sheet adjacent a one of either the transverse and parallel side seams and that is sized and shaped to enable insertion of an article into the pocket;

each cut dividing the back sheet of the pocket into a first portion that is attached at the adjacent one of either the transverse and parallel side seams and a second portion with the first portion comprising a tab that projects away from the adjacent one of either the transverse and parallel side seams and that is sized and shaped to enable manual grasping of the tab and lifting of the first portion of the back sheet of the pocket; and a stiff sheath in which the page is inserted, the stiff sheath being formed from stiff transparent material and including holes to enable binding of the sheath.

20. A storage system for holding and displaying substantially thin, flat articles that have a display face and a back face, the storage system comprising:

a page formed from a front sheet and a back sheet;

the front sheet having a top edge, a bottom edge, an interior edge, and an exterior edge, and being formed from at least translucent, plastic material with an exterior surface and an interior surface;

the back sheet having an exterior surface and an interior surface, the back sheet having its interior surface attached to the interior surface of the front sheet along a plurality of seam lines to form at least one pocket;

each of the at least one pockets having a longitudinal dimension greater than a transverse dimension, the longitudinal dimension defined by a pair of parallel longitudinal side seams and the transverse dimension defined by a pair of parallel transverse side seams, the longitudinal side seams and the transverse side seams sealing all sides of the pocket, each pocket having a cut formed in the back sheet adjacent one of either the transverse and parallel side seams and that is sized and shaped to enable insertion of an article into the pocket;

each cut dividing the back sheet of the pocket into a first portion that is attached at the adjacent one of either the transverse and parallel side seams and a second portion with the first portion comprising a tab that projects away from the adjacent one of either the transverse and parallel side seams and that is sized and shaped to enable manual grasping of the tab and lifting of the first portion of the back sheet of the pocket;

a stiff sheath in which the page is inserted, the stiff sheath being formed from stiff transparent material and including holes to enable binding of the sheath; and a releasable binder that releasably binds the stiff sheath in which the page is inserted, the releasable binder sized and shaped to enclose the stiff sheath.

* * * * *